US008057118B2

(12) United States Patent
Yuhas

(10) Patent No.: US 8,057,118 B2
(45) Date of Patent: Nov. 15, 2011

(54) DISPENSER SEAL

(75) Inventor: Andrew Yuhas, Jackson, NJ (US)

(73) Assignee: Colgate-Palmolive Company, New York, NY (US)

( * ) Notice: Subject to any disclaimer, the term of this patent is extended or adjusted under 35 U.S.C. 154(b) by 532 days.

(21) Appl. No.: 11/692,492

(22) Filed: Mar. 28, 2007

(65) Prior Publication Data

US 2007/0177929 A1 Aug. 2, 2007

Related U.S. Application Data

(63) Continuation of application No. PCT/US2005/034953, filed on Sep. 28, 2005.

(60) Provisional application No. 60/616,091, filed on Oct. 4, 2004.

(51) Int. Cl.
*B43K 1/06* (2006.01)
*B67B 5/00* (2006.01)

(52) U.S. Cl. ..... 401/265; 15/254; 222/153.06; 222/153.07; 222/542

(58) Field of Classification Search ..... 401/262, 401/265, 266, 263; 206/485; 222/153.01, 222/153.05, 153.06, 153.07, 188, 542; 215/250, 215/254, 256

See application file for complete search history.

(56) References Cited

U.S. PATENT DOCUMENTS

| | | | | | |
|---|---|---|---|---|---|
| 4,029,033 | A | * | 6/1977 | Kerwin et al. | 156/69 |
| 5,007,755 | A | * | 4/1991 | Thompson | 401/175 |
| 5,055,152 | A | * | 10/1991 | Inagaki | 156/244.11 |
| D381,899 | S | * | 8/1997 | Crawford | D9/729 |
| D385,779 | S | * | 11/1997 | Sokol et al. | D9/728 |
| 5,975,368 | A | | 11/1999 | Wood | |
| 6,419,412 | B1 | * | 7/2002 | Ostrowski et al. | 401/98 |
| 6,572,300 | B2 | * | 6/2003 | Altonen et al. | 401/266 |
| 6,939,072 | B2 | * | 9/2005 | Thiebaut | 401/266 |
| 7,100,806 | B2 | * | 9/2006 | Schuster et al. | 222/546 |
| 7,354,215 | B2 | * | 4/2008 | Rego et al. | 401/175 |
| 2004/0173645 | A1 | | 9/2004 | Vogel et al. | |

FOREIGN PATENT DOCUMENTS

DE 21 09 416 A1 9/1972

* cited by examiner

*Primary Examiner* — David Walczak
(74) *Attorney, Agent, or Firm* — Judy W. Chung

(57) ABSTRACT

A dispenser has a barrel which is closed at one end by a base and has a plurality of apertures at the other end through which a viscous material such as a gel or lotion is dispensed. In one aspect, the invention can be a dispenser for a viscous substance comprising: a barrel having a base at a first end and an upper wall area having a plurality of apertures at a second end; a seal unit having a bottom surface with a plurality of projections depending from the bottom surface; and the seal unit positioned so that the bottom surface of the seal unit is in contact with the upper wall area of the barrel and the plurality of projections enter into the plurality of apertures.

22 Claims, 5 Drawing Sheets

DISPENSER SEAL

CROSS REFERENCE TO RELATED APPLICATIONS

This application is a continuation of International Application No. PCT/US2005/034953 filed Sep. 28, 2005 which claims the benefit of U.S. Provisional Application Ser. No. 60/616,091 filed Oct. 4, 2004. The contents of both applications are incorporated herein by reference.

BACKGROUND OF THE INVENTION

Antiperspirant and deodorant products can be in the form of gels or lotions. These usually are sold in oval shaped dispensers where the lotion or gel is in the body of the dispenser. The dispenser is comprised of a barrel which is closed by a base on a lower end and has a plurality of dispensing openings on an upper end. The base may support an elevator which assists in dispensing the gel or lotion through the plurality of dispensing apertures. The elevator can be moved manually or through an elevator wheel activation mechanism attached to the base. The plurality of apertures usually is closed with a peelable foil seal. This is removed by the user and discarded. This foil provides a good seal. However, it requires another operation in the manufacturing process to apply the seal to the dispenser. Further, if the foil seal is not properly applied there can be leakage from the dispenser.

A new seal has been developed which gives leak proof seals. This seal is formed just subsequent to the formation of the barrel. The barrel is molded and a thermoplastic seal, preferably a thermoplastic elastomer seal, then is molded onto the barrel. The thermoplastic seal flows into each of the plurality of dispensing apertures of the barrel and separately seals each of these openings. This thermoplastic seal usually will be a one-time use seal. However a reusable seal adopting this concept could be developed for particular products if one is needed.

BRIEF SUMMARY OF THE INVENTION

This invention relates to a thermoplastic seal for a dispenser. More particularly this invention relates to a seal unit where projections on a thermoplastic elastomer seal close dispensing apertures of a dispenser.

The dispenser is comprised of a barrel, a base closing the barrel at one end of the barrel and a plurality of dispensing apertures on a surface at another end of the barrel. A seal unit closes the plurality of openings. The seal unit is a thermoplastic, and preferably a thermoplastic elastomer, having an elongated section with a plurality of projections from one side, each of the plurality of projections aligned to enter and to seal the plurality of dispensing apertures.

The base can support an elevator which assists in the dispensing of the substance in the barrel. The elevator can be adjusted by means of a threaded screw or moved manually in the barrel.

The seal unit in the preferred embodiment is of a single use type where it is removed and discarded. However it could be designed so that it can be replaced on the barrel to reseal the plurality of apertures. Additionally there can be one or more grip tabs on the seal unit to assist in its removal from the barrel. In a further preferred embodiment the projections should have coordinated tapers whereby the tips of projections have cross-sectional dimensions that are less than those of the aperture openings. This will provide for an ease in removing the seal but yet provide for a leakproof seal.

The seal unit is formed subsequent to the molding of the barrel. The thermoplastic of the seal unit is molded into the plurality of openings of the upper aperture surface of the barrel. In a preferred mode the seal unit is molded onto the barrel in the same mold in which the barrel is molded. This is through the use of injection molding and a two shot molding technique.

As used herein the thermoplastic can be any one of a class of thermoplastics, inclusive of the preferred thermoplastic elastomers. Thermoplastic elastomers are multi-phase compositions in which the phases are intimately dispersed or are bonded by block or graft copolymerization. When repeatedly heated they will flow and then reset to a flexible solid. They are comprised of a hard segment and a soft segment. The only restriction is that the thermoplastic elastomer must be substantially inert to the substance contained in the barrel and which is to be dispensed.

DETAILED DESCRIPTION OF THE INVENTION

The invention will now be described in its preferred embodiments with reference to the drawings. It will be described with regard to the use of the preferred thermoplastic elastomers and antiperspirant and deodorant lotion and gel dispensers. Modifications can be made to the preferred embodiments but will be within the concept of the present invention.

Figure 1:
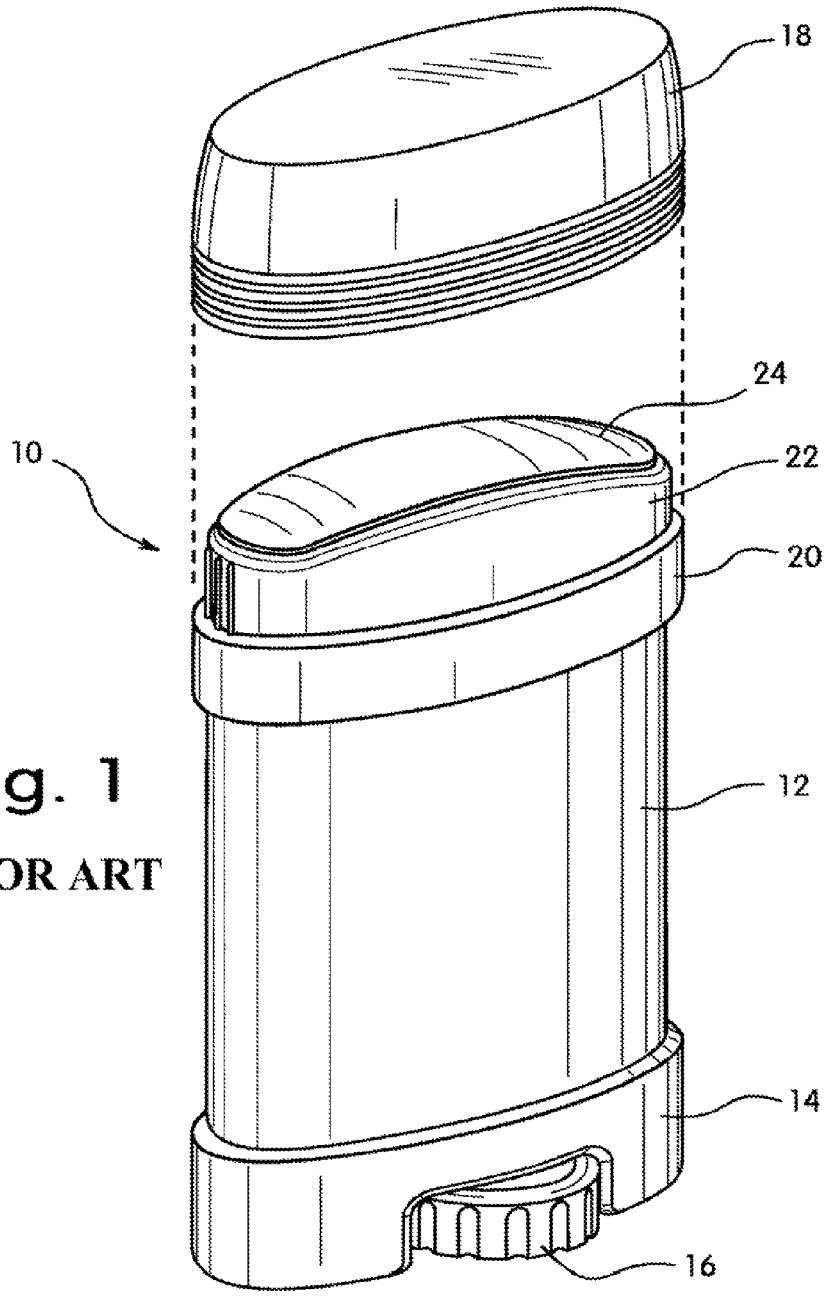
Fig. 1 PRIOR ART
FIG. 1 is a perspective view of a dispenser with the cap removed and showing a foil seal.

FIG. 1 shows a prior art seal on an antiperspirant or deodorant dispenser for lotions and gels. The dispenser 10 has a barrel 12, base 14, elevator activation wheel 16 and cap 18. On an upper part of the dispenser there is a collar 20 for securing the cap 18 onto the barrel 12. Above the collar there is a dispensing structure comprised of sidewall 22 and a top apertured wall area 26 (see FIG. 2). Overlaying the apertured wall area 26 is a foil seal 24.

Figure 2:
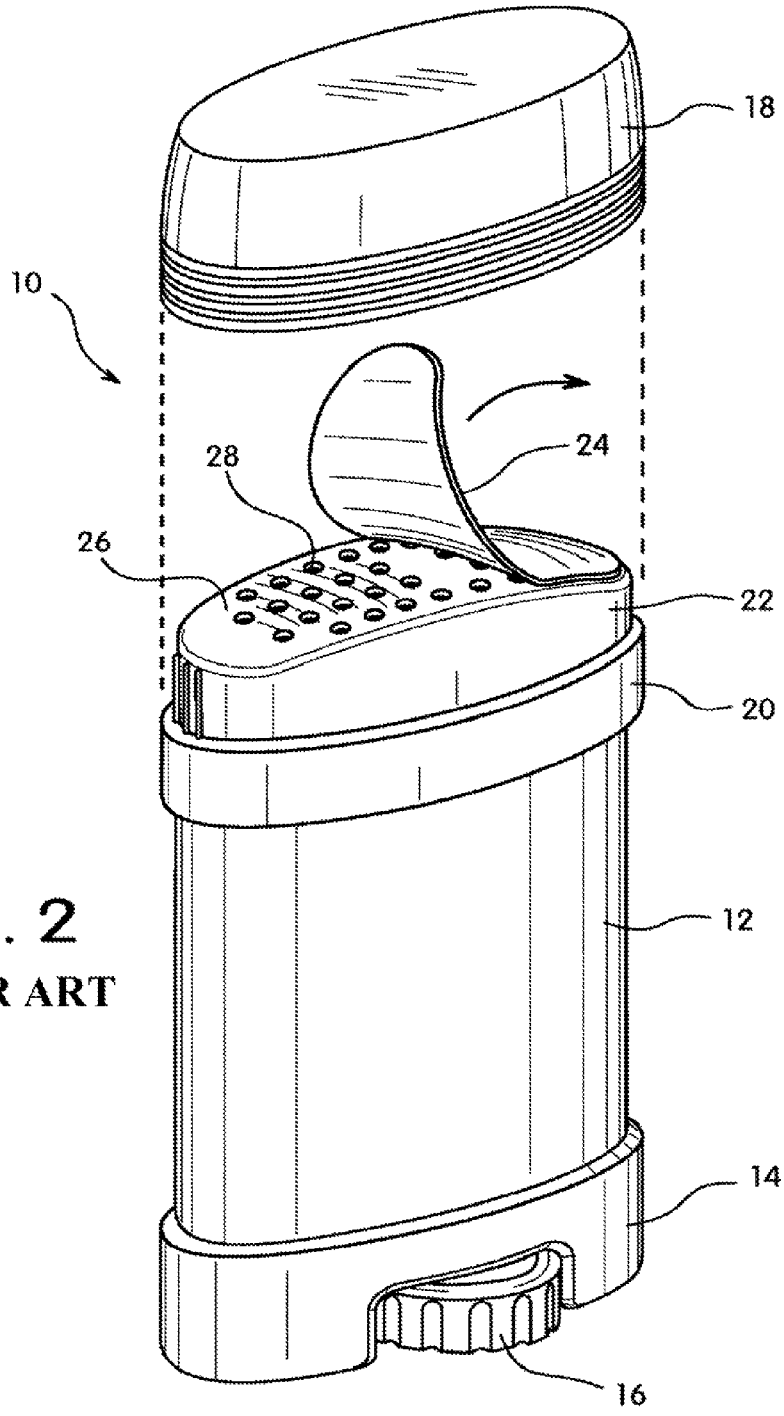
Fig. 2 PRIOR ART
FIG. 2 is a view of the dispenser of FIG. 1 with the foil seal removed.

FIG. 2 is a view of the dispenser of FIG. 1 with the foil seal 24 partially removed to show apertures 28 in top apertured wall area 26. This foil seal 24 has an adhesive on the side which contacts the top apertured wall area 26. This adhesive will maintain the foil seal 24 over the top apertured wall area 26 to seal the apertures 28 until the foil seal 24 is removed.

Figure 3:
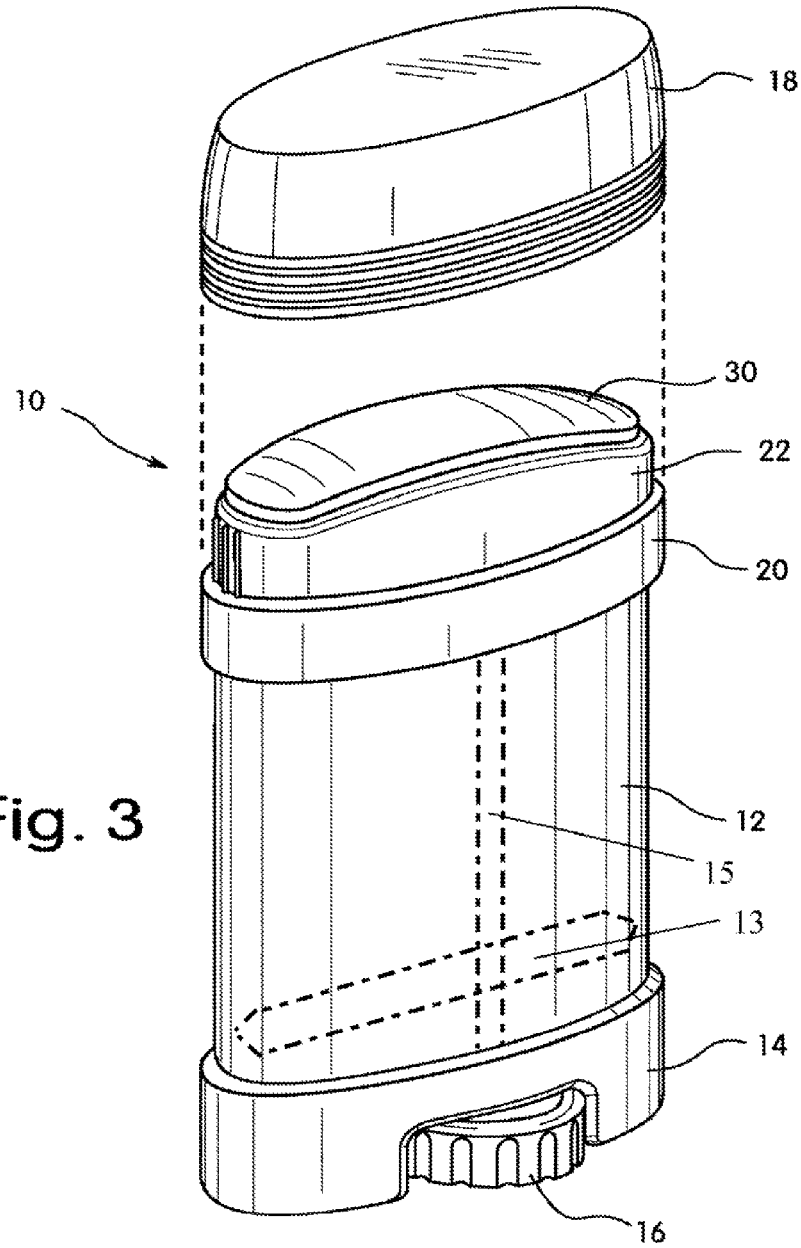
FIG. 3 is a perspective view of the dispenser with the present seal unit in place.
Figure 4:
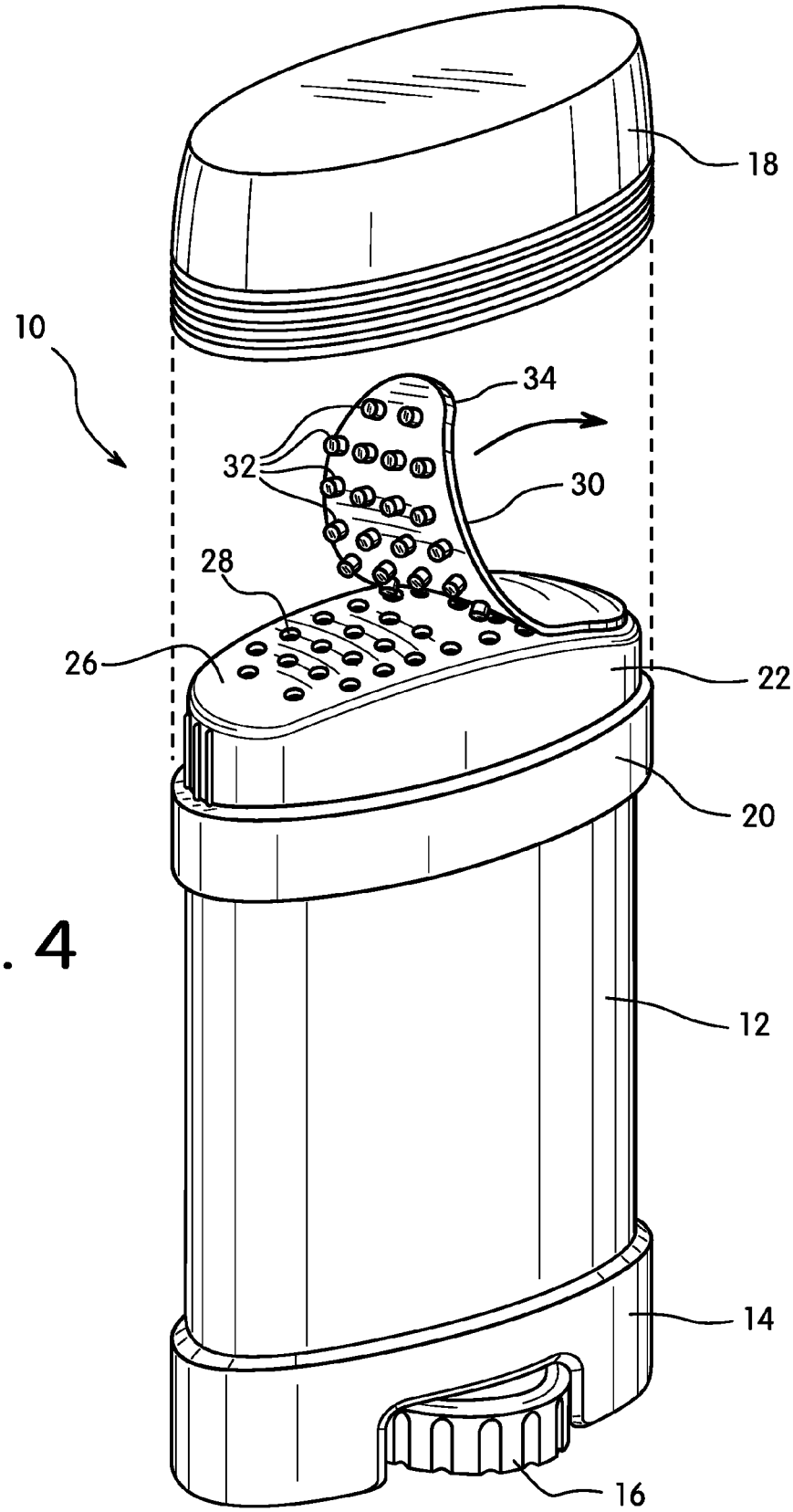
FIG. 4 is a view of FIG. 3 with the seal unit removed.

FIG. 3 shows an embodiment of the dispenser of the present invention. The dispenser 10 has a barrel 12, a base 14, an elevator activation wheel 16 for adjusting an elevator 13 by means of a screw 15 and a cap 18. The structure of the dispenser can be the same as in FIG. 1 and FIG. 2 except for the seal. In place of the foil seal 24 there is a polymeric seal unit 30. This polymeric seal unit 30 is shown in more detail in FIG. 4. As seen in FIG. 4 the polymeric seal unit 30 is comprised of a flexible substantially planar section 34 with a plurality of depending projections 32. These projections enter and seal the apertures 28 of the upper apertured wall area 26.

Figure 5:
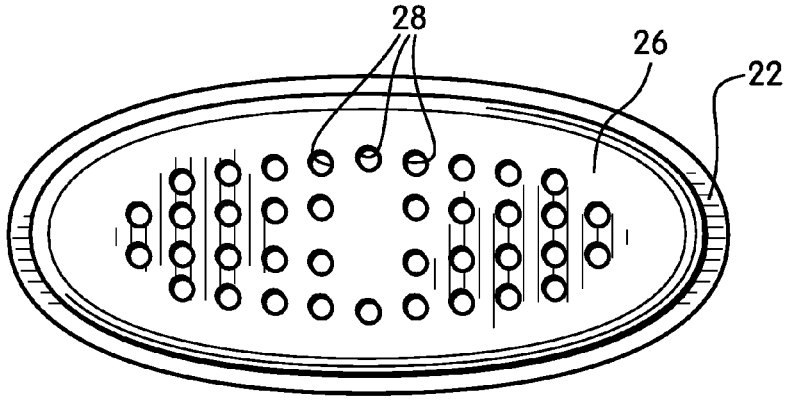
FIG. 5 is a top plan view of the dispenser without a seal.
Figure 6:
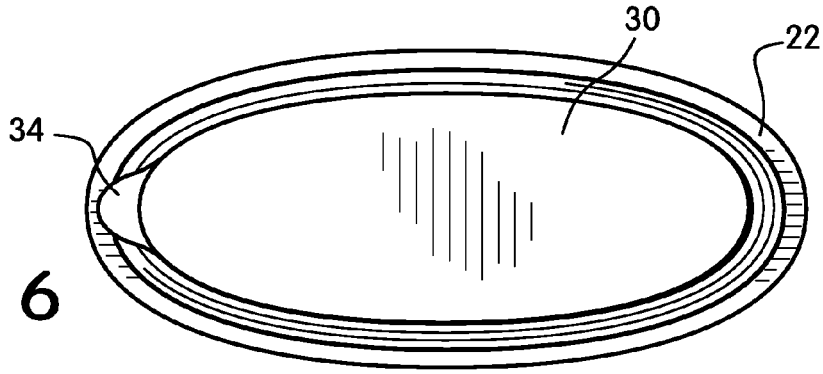
FIG. 6 is a top plan view of the dispenser of FIG. 3 with a grip tab seal unit.

FIG. 5 is a top plan view of a typical dispenser for gels and lotions. There is shown sidewall 22, upper apertured wall area 26 and the plurality of apertures 28. FIG. 6 shows the apertured upper wall area with polymeric seal 30 in place. In this embodiment the polymeric seal unit 30 has a grip pull tab 34. This is to assist in gripping the polymeric seal unit 30 for its removal. Optionally there also can be a grip tab on the other end.

Figure 7:
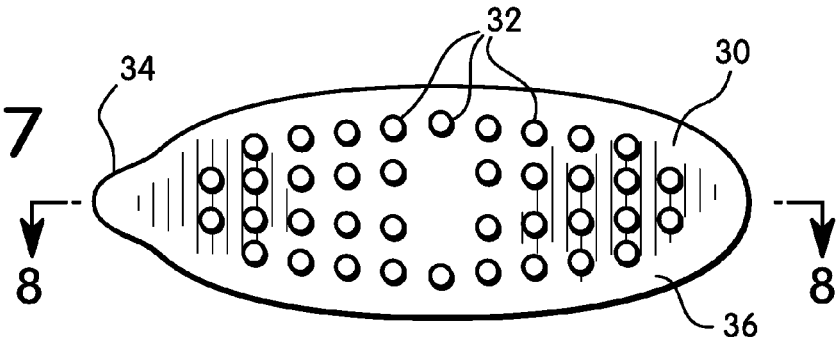
FIG. 7 is a bottom plan view of the seal unit of FIG. 3.
Figure 8:
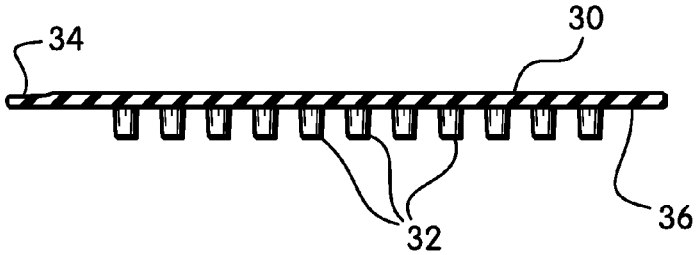
FIG. 8 is a cross-sectional view of the seal unit of FIG. 7 along line 8-8.

FIG. 7 is a bottom plan view of polymeric seal unit 30. This shows the substantially planar section 34 and the plurality of projections 32. These projections 32 will have a complementary shape to the apertures 28. These projections 32 are within apertures 28 and seal apertures 28. FIG. 8 is a cross-section view of the seal unit 30 of FIG. 7. These projections 32 have a taper which is complementary to a taper in apertures 28. The sidewalls of the apertures 28 and the projections 32 can be straight or have a taper. A tapered wall will assist in the removal of the seal unit 30. The projections preferably will have a taper whereby the cross-sectional dimensions of the tip of the projections is less than the cross-sectional dimensions of the openings of the apertures 28 on upper apertured wall area 26. The tapered walls of the projections 32 and the apertures 28 assist in the removal of the projections 32 from the apertures 28. The taper on the projections 32 and the apertures 28 can be about 2 degrees to about 8 degrees and preferably about 3 degrees to about 6 degrees.

The seal unit is comprised of a thermoplastic, and preferably a thermoplastic elastomer. A thermoplastic elastomer will effectively seal the apertures 28, but yet be relatively easy to remove to unseal the dispenser. The useful thermoplastic elastomers include the fine dispersion of a hard thermoplastic A and a soft thermoplastic B and block copolymers of an A-B-A structure. The A component can be polystyrene, polymethylstyrene, polysulfone, polyurethane, polyester, polycarbonate and polysilphenylene siloxane. The B component can be polybutadiene, polyisoprene, polydimethylsiloxane, polyester or polyether. Other polymers can be present as additives such and polypropylene and polyethylene. Commercially available thermoplastic elastomers include KRATON D and KRATON G from the Shell Chemical Company, SOLPRENE from the Phillips Petroleum Co., STEREON from the Firestone Co. and TUFPRENE from the Asahi Chemical Company, MP 2290 from Teknor Apex and a selection of elastomers from GLS Corp.

The seal unit can be removed and disposed of or it could be designed to be replaceable onto the apertures 28 with regard to particular products. If it is to be replaceable there should be a sufficient taper on the projections 32 and the apertures 28 so that the projections 32 can be easily fitted back into the apertures 28.

The preferred method of forming the polymeric seal is to mold it directly onto the upper apertured wall area 26. The thermoplastic elastomer is injection molded onto the upper surface 26 and into the apertures 28 in a single step. This will be done in a step following the injection molding of the barrel. The barrel is molded of a rigid thermoplastic, followed by the molding of the thermoplastic elastomer onto the upper surface 26. During the molding process the thermoplastic elastomer enters the apertures 28 and is formed to fill these apertures. A preferred technique is to use a two shot injection mold where the barrel 12 and the seal unit 30 are produced in the same mold in a two step process. First the barrel 12 is formed and the mold rotated and the thermoplastic elastomer injected into the apertures 28. However other molding techniques can be used including the use of two different molds.

As noted this seal is very useful for deodorant and antiperspirant products. These products are held in and dispensed from a container as described above and as shown in the drawings. However other skin treatment lotions can be dispensed from this type of a container. These include suntan lotions, poison ivy lotions, and eczema lotions.

What is claimed is:

1. A dispenser for a viscous substance comprising:

a barrel having a base at a first end and an upper wall area having a plurality of apertures at a second end;

a flexible sheet having a top surface and a bottom surface with a plurality of projections depending from the bottom surface;

the flexible sheet positioned so that the bottom surface of the flexible sheet is in contact with the upper wall area and the plurality of projections enter into the plurality of apertures; and wherein the flexible sheet comprises a thermoplastic elastomer directly molded onto the upper wall area and into the plurality of apertures.

2. A dispenser as in claim 1 wherein said base supports a rotatable screw.

3. A dispenser as in claim 2 wherein said rotatable screw extends from said base and supports an elevator which supports the viscous substance and flows the viscous substance toward said plurality of apertures upon the rotation of the screw.

4. A dispenser as in claim 1 wherein said flexible sheet has a pull tab on at least one end.

5. A dispenser as in claim 1 wherein said flexible sheet covers said upper wall area of the barrel.

6. A dispenser as in claim 1 wherein said plurality of projections taper from said bottom surface of said flexible sheet to a distal end and said plurality of apertures taper downwardly from said upper wall area, wherein the plurality of tapered projections have a complementary shape to the plurality of tapered apertures.

7. A dispenser as in claim 6 wherein the taper of said plurality of tapered projections is between 2 degrees to 8 degrees with a greater cross-sectional area adjacent the bottom surface of the flexible sheet than at the distal end thereof.

8. A dispenser as in claim 1 wherein said thermoplastic elastomer is selected from the group consisting of a fine dispersion of a hard polymer A and a soft polymer B and a graft coplymer having an A-B-A structure.

9. A dispenser as in claim 1 wherein the viscous substance is an antiperspirant.

10. A dispenser as in claim 1 wherein the viscous substance is a deodorant.

11. The dispenser as in claim 1 wherein the upper wall area is a convex surface.

12. The dispenser as in claim 11 wherein the bottom surface of the flexible sheet is flush with the upper wall area of the barrel when the plurality of projections enter into the plurality of apertures.

13. The dispenser as in claim 12 wherein the plurality of projections are arranged on the bottom surface of the flexible sheet in a pattern that corresponds to a pattern of the plurality of apertures on the upper wall area of the barrel.

14. The dispenser as in claim 1 wherein the flexible sheet is able to be replaced onto the upper wall area of the barrel after being removed therefrom.

15. A dispenser for a viscous substance comprising:

a barrel having a first end and a plurality of apertures at a second end;

a seal unit comprising a plurality of projections depending therefrom, the seal unit positioned atop the second end of the barrel so that the plurality of projections enter into the plurality of apertures;

a cap attached to the second end of the barrel;

the seal unit being disposed between the barrel and the cap and being a separable structure from the cap; and wherein the seal unit comprises a thermoplastic elastomer directly molded onto the second end and into the plurality of apertures.

16. The dispenser as in claim 15 wherein a space exists between a top surface of the seal unit and a bottom surface of a roof portion of the cap when the cap is secured to the barrel.

17. The dispenser as in claim 15 wherein the second end of the barrel has an upper wall area and wherein the seal unit has a bottom surface, the plurality of projections depending from the bottom surface and the seal unit positioned so that the bottom surface of the seal unit is in contact with the upper wall area of the barrel and the plurality of projections enter into the plurality of apertures.

18. A dispenser for a viscous substance comprising:

a barrel having a base at a first end and an upper wall area having a plurality of apertures at a second end;

a seal unit having a bottom surface with a plurality of projections depending from the bottom surface;

the seal unit positioned so that the bottom surface of the seal unit is in contact with the upper wall area of the barrel and the plurality of projections enter into the plurality of apertures; and wherein the seal unit comprises a thermoplastic elastomer directly molded onto the upper wall area and into the plurality of apertures.

19. The dispenser as in claim 18 wherein the seal unit is a sheet.

20. The dispenser as in claim 18 wherein said plurality of projections taper from said bottom surface of said seal unit to a distal end and said plurality of apertures taper downwardly from said upper wall area.

21. The dispenser as in claim 18 further comprising a cap attached to the second end of the barrel, and the seal unit being disposed between the barrel and the cap and being a separable structure from the cap.

22. The dispenser as in claim 21 wherein a space exists between a top surface of the seal unit and a bottom surface of a roof portion of the cap when the cap is secured to the barrel.

* * * * *